US007201275B2

(12) United States Patent
Nakagawa et al.

(10) Patent No.: US 7,201,275 B2
(45) Date of Patent: Apr. 10, 2007

(54) PTP FOR VISUALLY HANDICAPPED PERSON

(75) Inventors: Sachiko Nakagawa, Osaka (JP); Yoshihisa Hama, Osaka (JP); Yasuhiro Tsukamasa, Osaka (JP); Susumu Kimura, Osaka (JP); Takafumi Araki, Osaka (JP)

(73) Assignee: Nipro Corporation, Osaka (JP)

( * ) Notice: Subject to any disclaimer, the term of this patent is extended or adjusted under 35 U.S.C. 154(b) by 151 days.

(21) Appl. No.: 10/886,049

(22) Filed: Jul. 8, 2004

(65) Prior Publication Data

US 2005/0016893 A1 Jan. 27, 2005

(30) Foreign Application Priority Data

Jul. 10, 2003 (JP) ..... 2003-272753

(51) Int. Cl.
*B65D 83/04* (2006.01)

(52) U.S. Cl. ..... 206/531; 206/534; 116/205; 116/DIG. 17

(58) Field of Classification Search ..... 206/528, 206/530, 531, 534, 534.1, 534.2, 538, 539, 206/459.5; 40/310, 312; 116/205, DIG. 17
See application file for complete search history.

(56) References Cited

U.S. PATENT DOCUMENTS 3,921,805 A * 11/1975 Compere ..... 206/532
4,208,983 A * 6/1980 Buckley ..... 116/205
4,340,141 A * 7/1982 Fischer ..... 206/531
4,895,257 A * 1/1990 Winslow ..... 206/534
5,457,895 A * 10/1995 Thompson et al. ..... 34/296
5,730,292 A * 3/1998 Jones ..... 206/534
6,121,791 A * 9/2000 Abbott ..... 326/39
6,155,791 A * 12/2000 Powell ..... 417/36
6,422,391 B1 * 7/2002 Swartz ..... 206/531
6,499,421 B1 * 12/2002 Honigsbaum ..... 116/205
2002/0014028 A1 * 2/2002 Campeau ..... 40/310

FOREIGN PATENT DOCUMENTS

JP 6-190020 A 7/1994
JP 10-248905 A 9/1998

* cited by examiner

*Primary Examiner*—Luan K. Bui
(74) *Attorney, Agent, or Firm*—Kubovcik & Kubovcik

(57) ABSTRACT

A PTP constructed so that when the PTP is divided into a section having one or a plurality of pocket portions, a person can discriminate between the top, bottom, right and left sides of this section in the planar direction and a visually handicapped person can correctly identify the direction of medicament identifying means provided on the section. The PTP includes a flexible sheet having a pocket portion containing a tablet T, and a metal foil adhered to the flexible sheet to hermetically seal the pocket portion containing the tablet T, and the PTP is dividable into sections including a plurality of pocket portions by a dividing line. An unevenness serving as medicament identifying means is provided on a top surface of a pocket portion, and arcs are respectively formed on the dividing line on the sides so that the shapes of all the divided sections become the same.

8 Claims, 4 Drawing Sheets

PTP FOR VISUALLY HANDICAPPED PERSON

BACKGROUND OF THE INVENTION

1. Field of the Invention

The present invention relates to PTPs and, more particularly, to PTPs for visually handicapped persons.

2. Description of the Related Art

PTPs (press through packages) (sometimes referred to as "blister" packs) are generally known as containers which contain pharmaceutical solids such as tablets and capsules. A prior PTP 310 shown in FIG. 4 includes a flexible (cover) sheet 320 provided with pocket portions 322 each of which contains a tablet T, and a metal (backing) foil 370 which is stuck to the flexible sheet 320 to hermetically seal the tablet T contained in the pocket portion 322. The PTP 310 can be divided into sections 330 each including one or a plurality of pocket portions 322 as required.

It is prescribed that required items such as product name, usage, dose and identification marks based on law for promotion of effective utilization of resources be indicated on the PTP, and these indications are in many cases implemented by printing on the metal foil. However, the printing space of the metal foil is limited to a narrow space compared to the required items to be indicated. In the case where pharmaceutical solids whose stability tends to be impaired by light is contained, since the flexible sheet is colored to have light blocking characteristics, it is likely that an identification number, a color and the like imprinted or printed on each of the pharmaceutical solids and printing made on the metal sheet are difficult to view from the flexible sheet. Accordingly, prior PTPs have the problem that visually handicapped persons cannot identify the kinds of pharmaceutical solids contained in the PTP. In addition, there is the problem that persons, even if they are not visually handicapped, have difficulty in identifying the kinds of pharmaceutical solids contained in the PTP having light blocking characteristics.

To cope with these problems, an invention has been made in which an unevenness identifiable by tactile sensation is provided on a surface of a PTP so that the classification of effects, the usage and the dose of a medicament contained in the PTP are indicated by the unevenness (see Japanese Laid-open Publication No. JP 6-190020 A) ("Patent Document 1"). According to the invention of this patent document 1, even a visually handicapped person can identify the kind, the usage and the dose of a medicament contained in the PTP by recognizing the unevenness on the surface of the PTP by tactile sensation with his/her hands, fingers or the like.

However, the invention of this patent document 1 does not offer any problems as long as the figure formed by the unevenness does not have directionality, e.g., an "○ (circle)", but in the case where the figure formed by the unevenness has directionality, e.g., Braille or "Δ (triangle)", "+ (cross)" or "- (straight line)", it is likely that when the PTP is divided into sections, the top, bottom, right and left of the figure formed by the unevenness cannot be identified in the planar direction. For example, if a symbol indicating an inotropic agent, which is shown in patent document 1, page 4, Table 1 (2), is rotated 90°, the symbol becomes the same as a symbol indicating an antiphlogistic and analgesic agent, which is shown in (3). In this case, it is likely that a visually handicapped person will mistakenly identify the kind of medicament contained in the PTP and will take a wrong medicament.

BRIEF SUMMARY OF THE INVENTION

The problem that the present invention solves is to provide a PTP which is constructed so that even when the PTP is divided into a section having one or a plurality of pocket portions, a person can positively discriminate between the top, bottom, right and left of this section in the planar direction and even a visually handicapped person can correctly identify the direction of medicament identifying means provided on the section.

To solve the above-mentioned problem, the present inventors have made intensive research and reached the present invention. Namely, the invention relates to the following PTP and the like:

(1) A PTP including a flexible sheet having a pocket portion capable of containing a medicament, and a metal foil adhered to the flexible sheet to hermetically seal the pocket portion which contains the medicament, the PTP being dividable into sections each including one or a plurality of pocket portions by a dividing line, and comprising:

direction specifying means capable of specifying by tactile sensation a direction of a flat surface of each of the divided sections; and medicament identifying means capable of identifying by tactile sensation information relative to the medicament.

(2) In a PTP as in (1), the direction specifying means is a cut provided on the dividing line and/or a first unevenness provided on a surface of the PTP.

(3) In a PTP as in (1), the medicament identifying means is a second unevenness provided at a location different from the direction specifying means.

(4) In a PTP as in (3), the second unevenness is provided on a top surface of the pocket portion.

(5) In a PTP as in any of (1) to (4), all the divided sections have the same shape.

According to the invention, even when the PTP containing a medicament is divided into a section having one or a plurality of pocket portions, it is possible to positively discriminate between the top, bottom, right and left of this section in the planar direction, and it is possible to correctly identify the direction of the medicament identifying means provided on the top surface of the pocket portion. In addition when a patient is to press out the medicament, the patient necessarily presses the top surface of the pocket portion, so that the patient can identify in advance the kind, usage and dose of the contained medicament through the medicament identifying means, and prevent administration of a wrong medicament.

In the case where even persons who are not visually handicapped have difficulty in identifying by visual sensation the identification information printed on the metal foil of the light-blocking PTP, they can identify the kind, usage and dose of the contained medicament by identifying the medicament identifying means. Accordingly, medical-care professionals, patients and the like can be prevented from making mistakes during preparation, administration or swallowing.

BRIEF DESCRIPTION OF THE DRAWINGS

FIG. 1(*a*) is a plan view of a PTP, FIG. 1(*b*) is a cross-sectional view taken along line 1*b*—1*b*, and FIG. 1(*c*) is a plan view of a section. One section includes two pocket portions, and direction specifying means are provided on dividing lines on sides of the PTP.

FIG. 2(*a*) is a plan view of a PTP, FIG. 2(*b*) is a cross-sectional view taken along line 2*b*—2*b*, and FIG. 2(*c*) is a plan view of a section. One section includes one pocket portion, and direction specifying means are provided at the intersections of dividing lines.

FIG. 3(*a*) is a plan view of a PTP, FIG. 3(*b*) is a cross-sectional view taken along line 3*b*—3*b*, and FIGS. 3(*c*) and 3(*d*) are plan views of sections, respectively. One section includes two pocket portions, and direction specifying means is an embossment provided on each section.

FIG. 4(*a*) is a plan view, FIG. 4(*b*) is a rear view, FIG. 4(*c*) is a cross-sectional view taken along line D—D, and FIG. 4(*d*) is a plan view of a section.

DETAILED DESCRIPTION OF THE INVENTION

Figure 1:
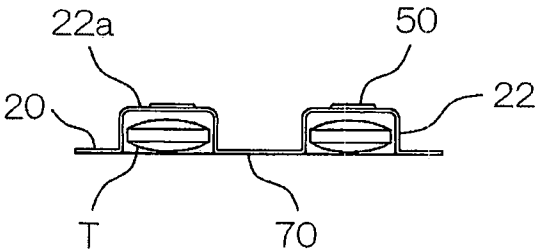
FIG. 1 is a view showing Embodiment 1.
Figure 1:
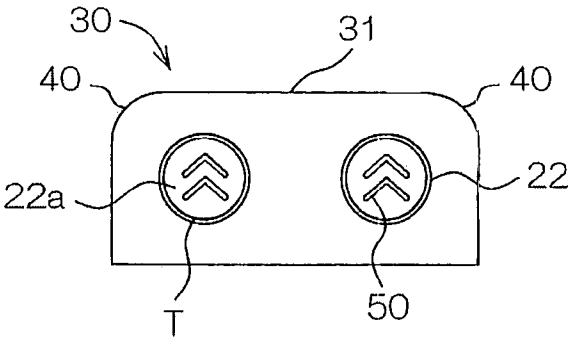
Figure 1:
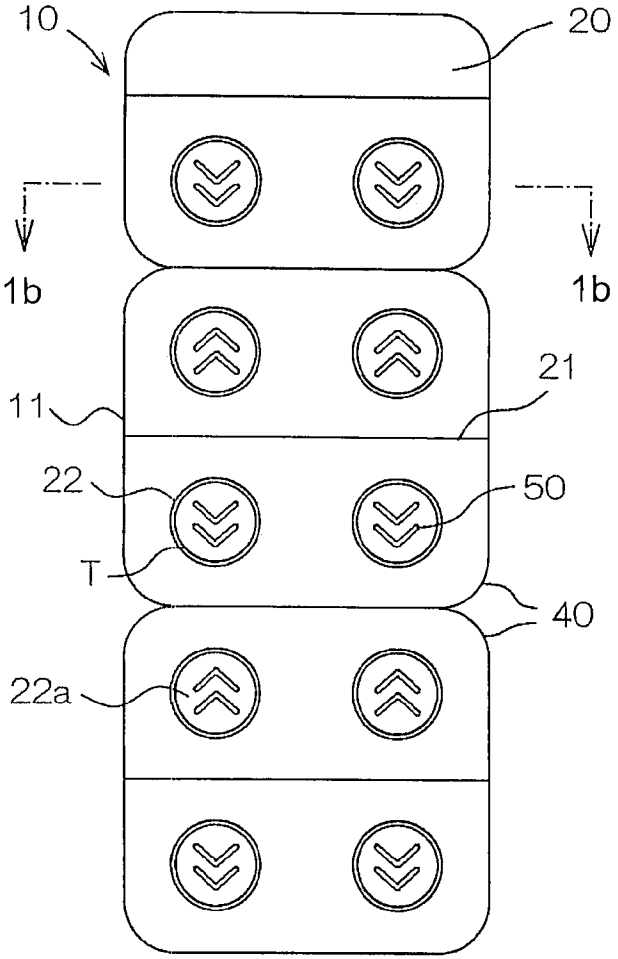

The PTPs shown in FIGS. 1 to 4 respectively include flexible sheets 20, 120, 220 and 320 provided with pocket portions 22, 122, 222 and 322 each of which contains a tablet T, and metal foils 70, 170, 270 and 370 which are adhered to the flexible sheets 20, 120, 220 and 320 to hermetically seal the pocket portions 22, 122, 222 and 322. The PTPs are the same in construction in that they can be divided into sections 30, 130, 230 and 330 including one or a plurality of pocket portions 22, 122, 222 and 322 by dividing lines 21, 121, 221 and 321, respectively. Their differences resides in the presence or absence of direction specifying means and medicament identifying means, or the structures thereof.

As a method of adhering the flexible sheets 20, 120, 220 and 320 to the metal foils 70, 170, 270 and 370, fusion bonding, press bonding or the like is suitably adopted, but is not particularly limited as long as the sheets can be stuck liquid-tightly and non-strippably. As the dividing lines 21, 121, 221 and 321, notched lines or depressed grooves are suitably adopted, but their constructions are not particularly limited as long as the PTPs can be divided or broken.

The number of pocket portions included in each section, in general, has recently been only one, but there is currently also a type in which the number of pocket portions included in each section is two or more. This is because when a patient divides a PTP into a section having one pocket portion, the patient sometimes forgets to take a tablet out of this section and swallows the section itself, so that the alimentary canal may be injured.

As the materials of the flexible sheets 20, 120, 220 and 320, polyethylene, polypropylene, polyethylene terephthalate, polyethylene naphthalate, polyvinyl alcohol, ethylene-vinyl alcohol copolymer, polyvinylidene chloride and nylon, or mixtures of these materials, or layered structures of these materials are enumerated, and the kinds of materials are not particularly limitative as long as they are known for use as forming materials of flexible sheets for PTPs.

As the materials of the metal foils 70, 170, 270 and 370, aluminum is most suitably adopted, but the kinds of materials are not particularly limited as long as they are known for use as metal foils for PTPs.

[Embodiment 1]

A PTP 10 of Embodiment 1 shown in FIG. 1 is dividable into sections 30 each including two pocket portions 22 by dividing line 21, and direction specifying means, i.e., arcs 40, which are respectively formed as cuts on the dividing line 21 on sides 11 of the PTP 10. Preferably, the arcs 40 respectively have the same radii as the arcs of the four corners of the PTP. The direction specifying means is preferably provided so that the shapes of all the divided sections 30 become the same. Any of the divided sections 30 of Embodiment 1 has an approximately rectangular shape having a side 31 containing the arcs 40 at the opposite ends.

An unevenness 50 indicative of the kind of tablet T is provided on a top surface 22*a* of each of the pocket portions 22. As the unevenness 50, a "double hill" figure is adopted in this embodiment, but any other figure can be used, and of course, Braille can also be used. The unevenness 50 may be molded when the pocket portion 22 is being formed, or may also be added after the pocket portion 22 has been formed. In the case where the unevenness 50 is added later, the thickness of the flexible sheet does not become thin in a portion of the unevenness 50, so that it is less likely that the stability of the tablet T contained inside is impaired.

In addition, if the side 31 of the section 30 that has the arcs 40 at the opposite ends is designated as the top, the top of the unevenness 50 is defined as a matter of course, and in the case of the unevenness 50 of Embodiment 1, the top of the double hill is always recognized as the top, and an open side of the double hill is always recognized as the bottom. Accordingly, by turning upside down the figure representative of the same double hill, it is possible to adopt the figure as a medicament identifying means indicative of a medicament of a kind different from the medicament indicated by the unevenness 50.

[Embodiment 2]

Figure 2:
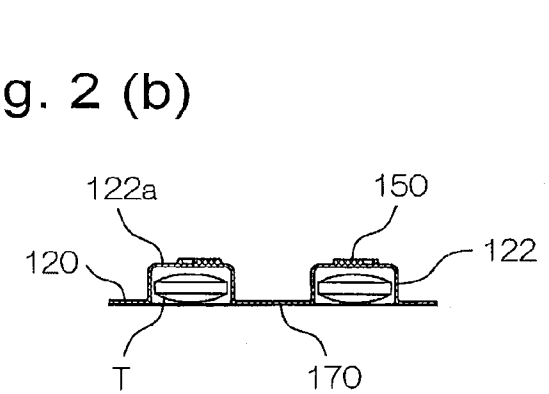
FIG. 2 is a view showing Embodiment 2.
Figure 2:
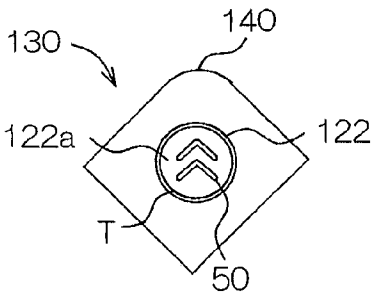
Figure 2:
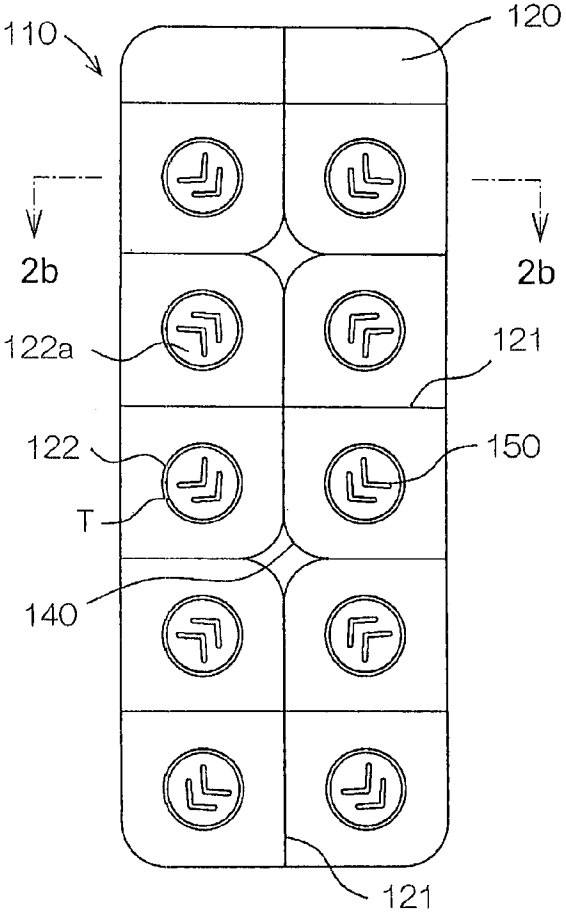

A PTP 110 of Embodiment 2 shown in FIG. 2 is dividable into sections 130 each including one pocket portion 122 by dividing line 121, and the direction specifying means is an arc 140 which is formed at the intersection of the dividing lines 121 of the PTP 110. Preferably, the arc 140 has the same radius as the arc of any of the four corners of the PTP 110. The direction specifying means is preferably provided so that the shapes of all the divided sections 130 become the same. Any of the divided sections 130 of Embodiment 2 has an approximately square shape having the arc 140 on one of its four corners.

An unevenness 150 indicative of the kind of tablet T is provided on a top surface 122*a* of each of the pocket portions 122. As the unevenness 150, a "double hill" figure is adopted in this embodiment, but any other figure can be used, and of course, Braille can also be used. The unevenness 150 may be molded when the pocket portion 122 is being formed, or may also be added after the pocket portion 122 has been formed. In the case where the unevenness 150 is added later, the thickness of the flexible sheet is not reduced in a portion of the unevenness 150, so that it is less likely that the stability of the tablet T contained inside is impaired.

In addition, if the arc 140 of the section 130 is designated as the top, the top of the unevenness 150 is defined as a matter of course, and in the case of the unevenness 150 of Embodiment 2, the top of the double hill is always recognized as the top, and an open side of the double hill is always recognized as the bottom. Accordingly, by turning upside down the figure representative of the same double hill, it is possible to adopt the figure as medicament identifying means indicative of a medicament of a kind different from the medicament indicated by the unevenness 150.

[Embodiment 3]

Figure 3:
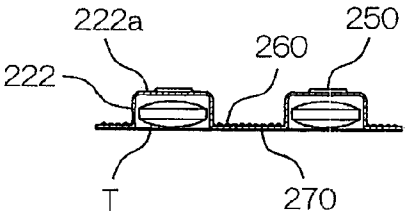
FIG. 3 is a view showing Embodiment 3.
Figure 3:
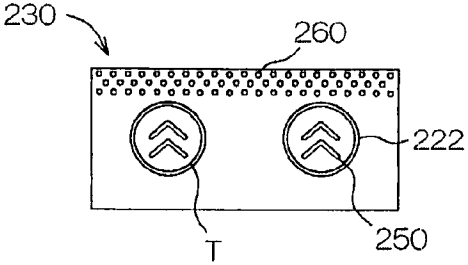
Figure 3:
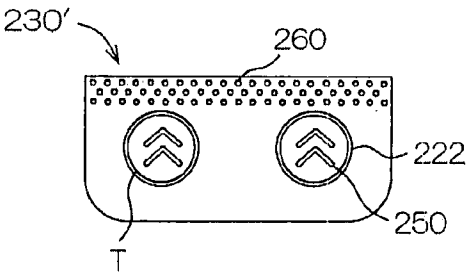
Figure 3:
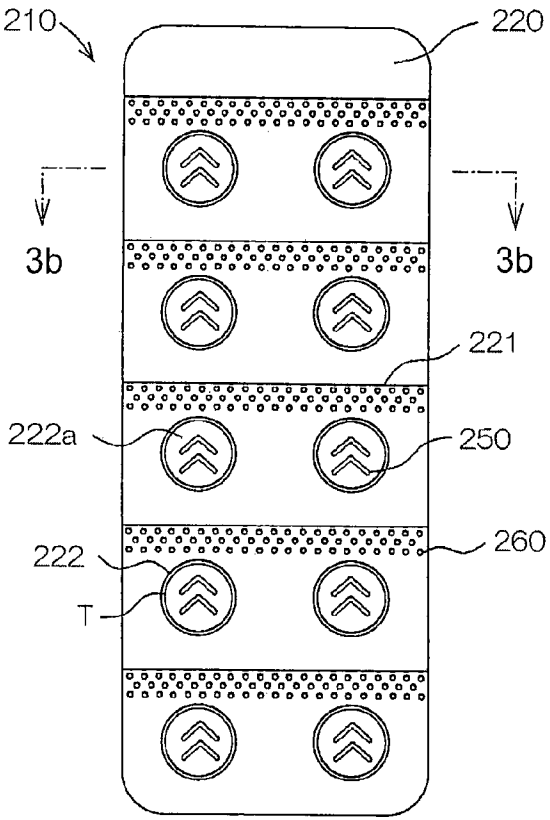
Figure 4:
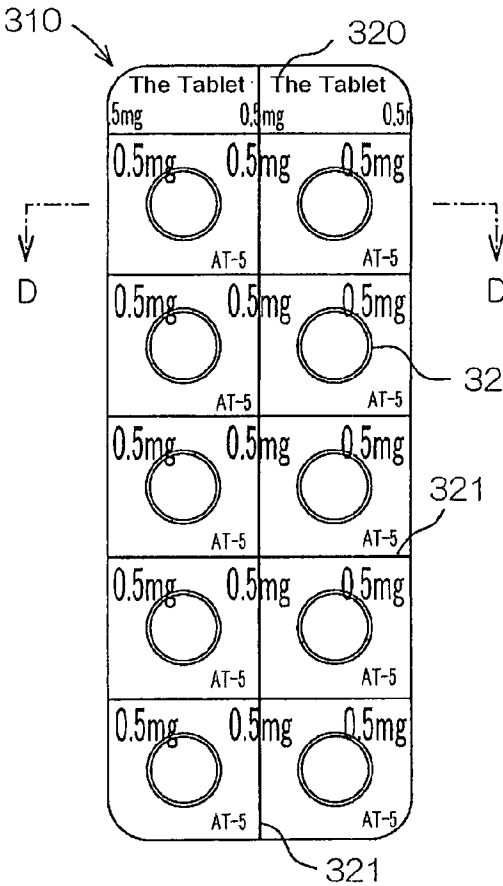
FIG. 4 is a view showing the prior art of the invention.
Figure 4:
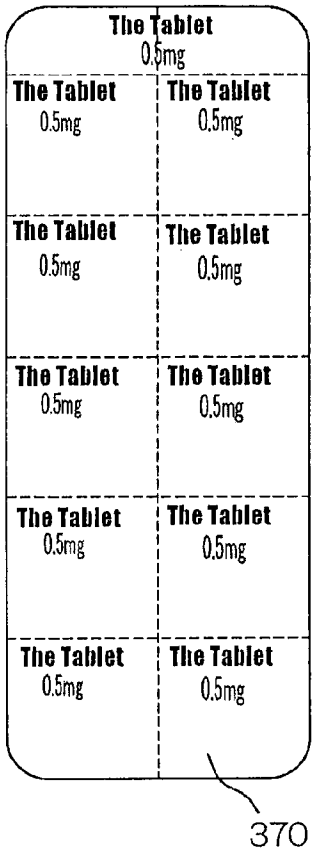
Figure 4:
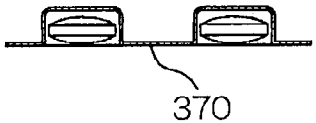
Figure 4:
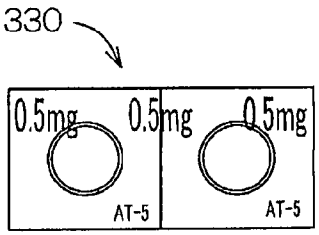

A PTP 210 of Embodiment 3 shown in FIG. 3 is dividable into sections 230 and 230', each including two pocket portions 222, by dividing line 221, and the direction specifying means is a first unevenness 260 provided on a surface of the PTP 210 (in this embodiment, an embossment is adopted). Each of the divided sections 230 and 230' of Embodiment 3 has an approximately rectangular shape having a side 231 containing the first unevenness 260. It is to be noted that Embodiment 3 differs from Embodiment 1 and Embodiment 2 in that the shapes of all the divided sections need not be the same and may be different flat shapes like the sections 230 and 230'. This is because directions are not specified by the flat shapes of the sections.

A second unevenness 250 indicative of the kind of tablet T is provided on a top surface 222*a* of each of the pocket portions 222. As the second unevenness 250, a "double hill" figure is adopted in this embodiment, but any other figure can be used, and of course, Braille can also be used. The second unevenness 250 may be molded when the pocket portion 222 is being formed, or may also be added after the pocket portion 222 has been formed. In the case where the second unevenness 250 is added later, the thickness of the flexible sheet does not become thin in a portion of the second unevenness 250, so that it is less likely that the stability of the tablet T contained inside is impaired.

In addition, if the side of the section 230 that has the first unevenness 260 is designated as the top, the top of the second unevenness 250 is defined as a matter of course, and in the case of the second unevenness 250 of Embodiment 3, the top of the double hill is always recognized as the top, and an open side of the double hill is always recognized as the bottom. Accordingly, by turning upside down the figure representative of the same double hill, it is possible to adopt the figure as medicament identifying means indicative of a medicament of a kind different from the medicament indicated by the unevenness 250.

It is to be noted that both a second unevenness and a cut may also be provided as the direction specifying means. This makes it far easier to specify the direction of a section.

What is claimed is:

1. A PTP including a flexible sheet having a pocket portion capable of containing a medicament, and a metal foil adhered to the flexible sheet to hermetically seal the pocket portion which contains the medicament, the PTP being dividable into sections including one or a plurality of pocket portions by a dividing line, comprising:

medicament identifying means capable of identifying by tactile sensation information relative to the medicament; and direction specifying means capable of specifying by tactile sensation a direction of the medicament identifying means of each of the sections.

2. A PTP according to claim 1, wherein the direction specifying means is a cut provided on the dividing line and/or a first unevenness provided on a surface of the PTP.

3. A PTP according to claim 1, wherein the medicament identifying means is a second unevenness provided at a location different from the direction specifying means.

4. A PTP according to claim 3, wherein the second unevenness is provided on a top surface of the pocket portion.

5. A PTP according to claim 1, wherein all the divided sections have the same shape.

6. A PTP according to claim 2, wherein all the divided sections have the same shape.

7. A PTP according to claim 3, wherein all the divided sections have the same shape.

8. A PTP according to claim 4, wherein all the divided sections have the same shape.

* * * * *